US005560383A

United States Patent [19]

Fuller

[11] Patent Number: 5,560,383

[45] Date of Patent: Oct. 1, 1996

[54] WAGON CANOPY APPARATUS

[76] Inventor: Rhonda S. Fuller, 315 E. Hazelcroft Ave., New Castle, Pa. 16105

[21] Appl. No.: 351,953

[22] Filed: Dec. 8, 1994

[51] Int. Cl.[6] ..... E04H 15/06

[52] U.S. Cl. ..... 135/88.01; 135/88.09; 297/184.15

[58] Field of Search ..... 135/96, 88.07, 135/88.01, 88.02, 88.18, 88.08, 88.15; 297/184.1, 184.11, 184.15

[56] References Cited

U.S. PATENT DOCUMENTS

| | | | |
|---|---|---|---|
| 2,530,765 | 11/1950 | Greenup | 135/98 |
| 2,652,845 | 9/1953 | O'Neill et al. | 135/98 X |
| 3,243,230 | 3/1966 | Otto | 135/96 X |
| 3,404,915 | 10/1968 | Filho | 297/184.1 X |
| 3,688,787 | 9/1972 | Feather . | |
| 4,293,162 | 10/1981 | Pap et al. | 135/96 X |
| 4,641,676 | 2/1987 | Lynch . | |
| 4,756,325 | 7/1988 | Daniels . | |
| 5,020,557 | 6/1991 | Apple . | |
| 5,096,257 | 3/1992 | Clark | 135/96 X |
| 5,205,308 | 4/1993 | Kendall et al. | 135/96 X |
| 5,232,005 | 8/1993 | Mitchell . | |
| 5,240,020 | 8/1993 | Byers | 297/184.15 X |

FOREIGN PATENT DOCUMENTS

| | | | |
|---|---|---|---|
| 1417654 | 10/1965 | France | 135/96 |
| 2322565 | 5/1977 | France | 297/184.15 |
| 0442530 | 7/1949 | Italy | 135/96 |

*Primary Examiner*—Lanna Mai

[57] ABSTRACT

A wagon canopy apparatus includes a support bracket assembly adapted to be attached to a wagon. A first support assembly is adapted to be connected to the support bracket assembly. A second support assembly is adapted to be oriented at a right angle in connection to the first support assembly. A primary hinge assembly is connected between the first support assembly and the second support assembly. The primary hinge assembly permits movement of the second support assembly from an non-use orientation to an in-use orientation with respect to the first support assembly. A canopy element is supported by the second support assembly and covers the wagon when the second support assembly is in the in-use orientation. The primary hinge assembly is connected between the first support assembly and the second support assembly such that the canopy element is adapted to lie in a first plane when the canopy element is in a non-use orientation, and the canopy element lies in a second plane when the canopy element is in an in-use orientation.

12 Claims, 3 Drawing Sheets

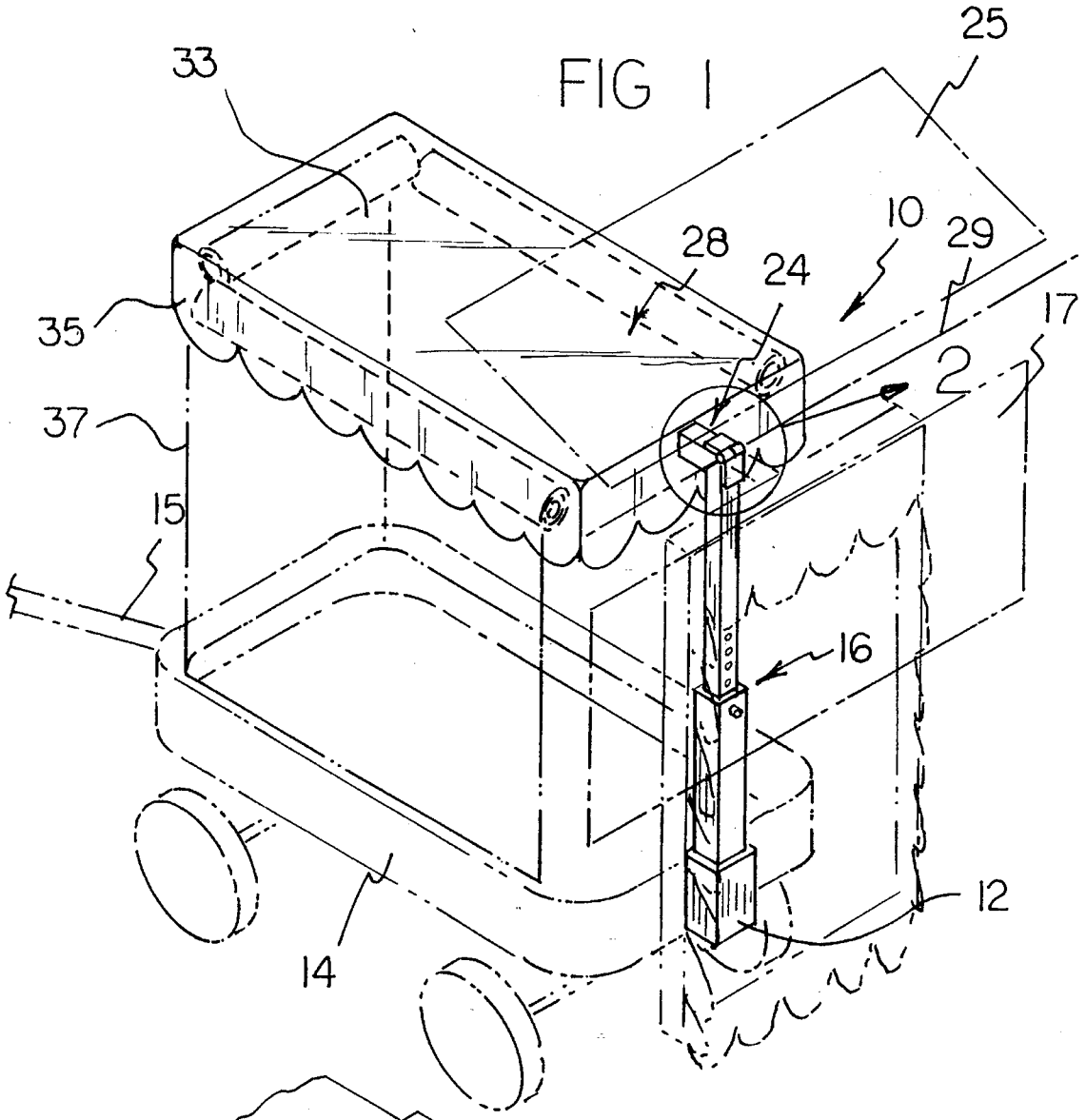
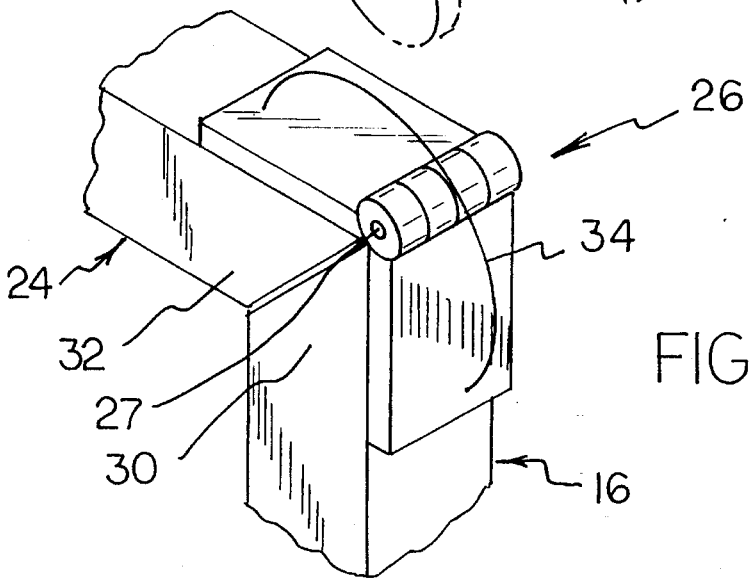
FIG 2

FIG 3
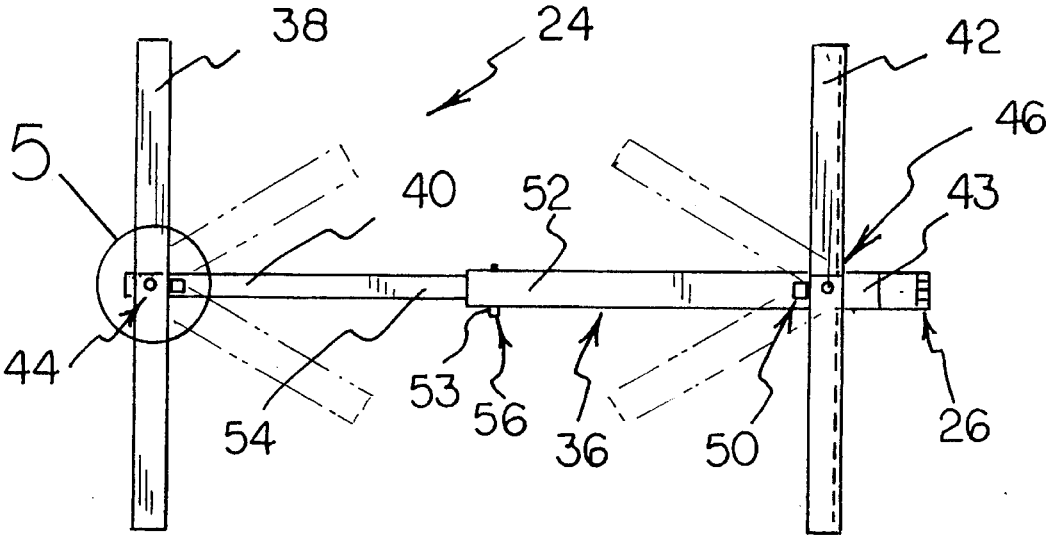
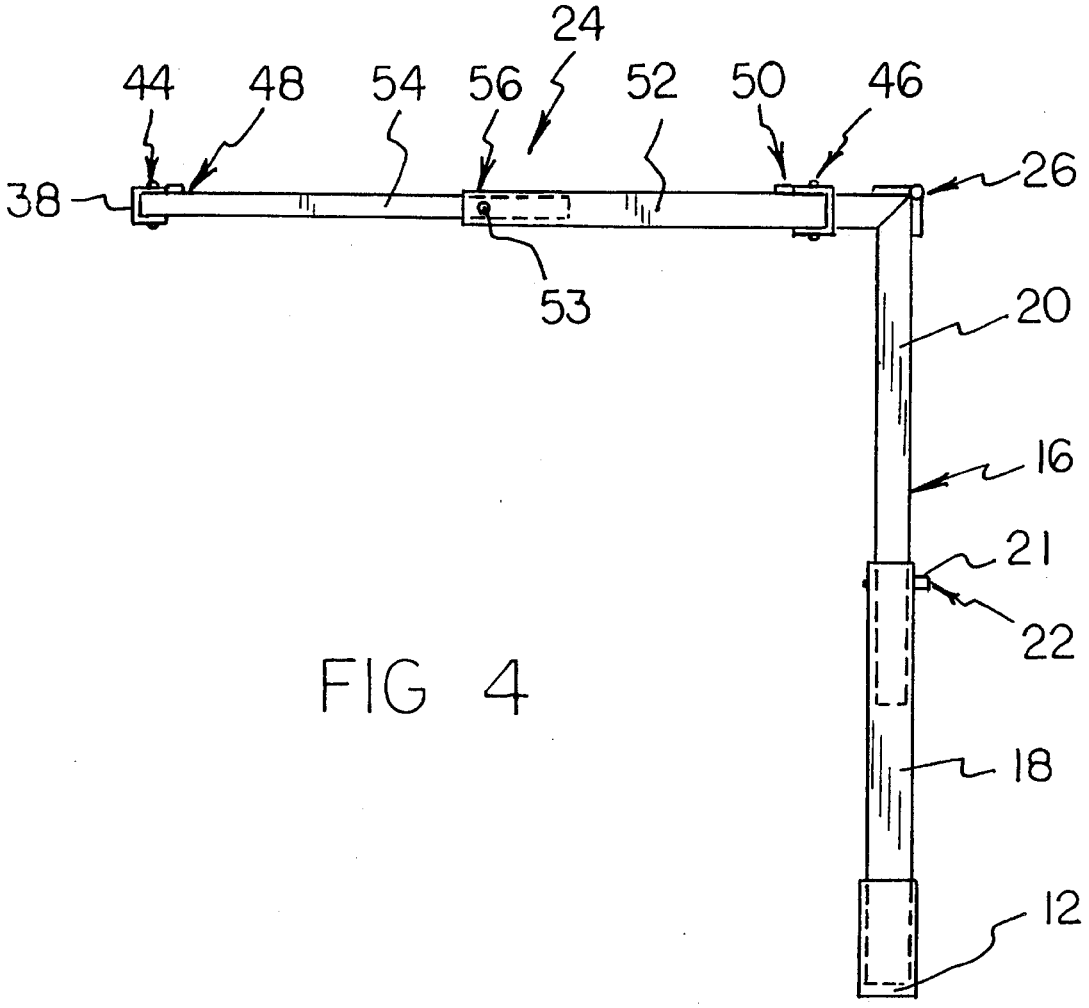
FIG 4

WAGON CANOPY APPARATUS

BACKGROUND OF THE INVENTION

1. Field of the Invention

The present invention relates generally to vehicle covers and, more particularly, to a canopy especially adapted for use with a wagon.

2. Description of the Prior Art

There are a number of types of covers for a variety of vehicles. For example, U.S. Pat. No. 3,688,787 discloses a longitudinally collapsible canopy for a pickup truck. U.S. Pat. No. 4,756,325 discloses another collapsible canopy for a pickup truck. No provision is made in either patent for raising or lowering the vehicle canopy during use.

U.S. Pat. No. 5,232,005 discloses a canopy for a riding mower. This canopy can be adjusted by separate adjustments in a vertical and horizontal direction. Yet, no single adjustment can adjust the canopy simultaneously in both a vertical and horizontal direction.

Baby strollers also often have canopies. Such canopies are supported by the rigidly oriented handles of the stroller that are used for pushing the stroller, and such canopies are often adjustable both vertically and horizontally with one adjustment action by rotating the canopy about pivots on the rigidly oriented handles.

U.S. Pat. No. 5,020,557 may be of interest for its disclosure of a rotating canopy umbrella that is not associated with a vehicle. U.S. Pat. No. 4,641,676 may also be of interest for its disclosure of a four-legged collapsible canopy that is supported by a ground surface.

It is noted that the prior art discussed above does not disclose a canopy that is designed to be used with a wagon, such as a four-wheeled wagon commonly used by children. Moreover, the vehicle canopies discussed above have features which prevent their practical use with a wagon. For example, a canopy that is collapsible in only one direction, such as longitudinally, cannot be folded up into a compact package for storing. In this respect, it would be desirable if a collapsible canopy could be folded up in plural directions. It would also be desirable if a wagon canopy could be mowed both vertically and horizontally with a single adjustment.

A wagon that is used for and by children often has a handle that has a pivoted attachment to the front wheels of the wagon. The handle is used for both pulling and steering the wagon. Such a wagon handle precludes the placement of a canopy on the handle. In this respect, it would be desirable if a rotatable canopy were provided for a wagon that was not attached to the wagon handle.

Still other features would be desirable in a wagon canopy apparatus. When a canopy would be used with a wagon, it would be desirable that the wagon canopy does not interfere with the steering and pulling movements of the wagon canopy. It would also be desirable to rotate the canopy out of the way to load and unload the wagon. When a canopy is placed in position, it is generally desirable that the canopy be oriented in a horizontal orientation. In this respect, it would be desirable for a wagon canopy to automatically be oriented in a horizontal direction when the canopy is rotated from an out-of-use orientation to an in-use orientation.

The term canopy is understood to mean both the canopy portion per se and the support structure for the canopy per se. In this regard, when a canopy is transformed from an out-of-use orientation to an in-use orientation, it would be desirable if the support structure readily locks into an in-use orientation.

Thus, while the foregoing body of prior art indicates it to be well known to use canopies for vehicles, the prior art described above does not teach or suggest a wagon canopy apparatus which has the following combination of desirable features: (1) is designed to be used with a wagon, such as a four-wheeled wagon commonly used by children; (2) provides a collapsible canopy which can be folded up in plural directions; (3) can be moved both vertically and horizontally with a single adjustment; (4) provides a rotatable canopy for a wagon that is not attached to the wagon handle; (5) does not interfere with the steering and pulling movements of the wagon handle; (6) enables the wagon canopy to be rotated out of the way for loading and unloading the wagon; (7) is automatically be in a horizontal direction when the canopy is rotated from an out-of-use orientation to an in-use orientation; and (8) has a support structure that readily locks into an in-use orientation when the canopy is transformed from an out-of-use orientation to an in-use orientation. The foregoing desired characteristics are provided by the unique wagon canopy apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a wagon canopy apparatus which includes a support bracket assembly adapted to be attached to a wagon. A first support assembly is adapted to be connected to the support bracket assembly. A second support assembly is adapted to be oriented at a right angle in connection to the first support assembly. A primary hinge assembly is connected between the first support assembly and the second support assembly. The primary hinge assembly permits movement of the second support assembly from an non-use orientation to an in-use orientation with respect to the first support assembly. A canopy element is supported by the,second support assembly and covers the wagon when the second support assembly is in the in-use orientation.

The first support assembly lies in a first plane, and the second support assembly lies in a second plane. The first plane and the second plane are at right angles to each other. The primary hinge assembly includes a hinge pin that lies adjacent to a line formed by an intersection of the first plane and the second plane. The primary hinge assembly is connected between the first support assembly and the second support assembly such that the canopy element is adapted to lie in the first plane when the canopy element is in a non-use orientation, and the canopy element lies in the second plane when the canopy element is in an in-use orientation. The primary hinge assembly permits the second support assembly to rotate around the first support assembly through an arc of two hundred seventy degrees when the second support assembly is rotated with respect to the first support assembly during shifting the second support assembly from an in-use orientation to a non-use orientation.

The first support assembly includes a first half-right-angle edge adjacent to the primary hinge assembly. The second support assembly includes a second half-right-angle edge adjacent to the primary hinge assembly. The first half-right-angle edge is adapted to contact the second half-right-angle edge to form a right angle when the second support assembly is an in-use orientation with respect to the first support assembly.

The first support assembly includes an outer telescopic member adapted for connection to the support bracket assembly. An inner telescopic member is adapted for insertion and adjustment in the outer telescopic member, and a first locking assembly, supported by the outer telescopic member and the inner telescopic member, is adapted for locking the inner telescopic member with respect to the outer telescopic member.

The second support assembly includes a longitudinal strut assembly connected to the primary hinge assembly. A first transverse strut assembly is connected to a distal end of the longitudinal strut assembly, and a second transverse strut assembly is connected to a proximal end of the longitudinal strut assembly. The first transverse strut assembly is connected to the distal end of the longitudinal strut assembly by a pivot assembly, and the second transverse strut assembly is connected to the proximal end of the longitudinal strut assembly by a pivot assembly.

A second locking assembly is provided for locking the first transverse strut assembly to the longitudinal strut assembly in an in-use orientation, and a third locking assembly is provided for locking the second transverse strut assembly to the longitudinal strut assembly in an in-use orientation.

The longitudinal strut assembly includes an outer longitudinal tube connected to the primary hinge assembly, and an inner longitudinal tube inserted in and in sliding engagement with the outer longitudinal tube. A fourth locking assembly, supported by the outer longitudinal tube and the inner longitudinal tube, is provided for locking the outer longitudinal tube and the inner longitudinal tube together in a selected position. The first transverse strut assembly is pivotally connected to the inner longitudinal tube, and the second transverse strut assembly is pivotally connected to the outer longitudinal tube.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wagon canopy apparatus which has all of the advantages of the prior art and none of the disadvantages.

It is another object of the present invention to provide a new and improved wagon canopy apparatus which may be easily and efficiently manufactured mad marketed.

It is a further object of the present invention to provide a new and improved wagon canopy apparatus which is of durable and reliable construction.

An even further object of the present invention is to provide a new and improved wagon canopy apparatus which is susceptible of a low cost of manufacture with regard to both materials and labor, and which accordingly is then susceptible of low prices of sale to the consuming public, thereby making such wagon canopy apparatus available to the buying public.

Still yet a further object of the present invention is to provide a new and improved wagon canopy apparatus which is designed to be used with a wagon, such as a four-wheeled wagon commonly used by children.

Still another object of the present invention is to provide a new and improved wagon canopy apparatus that provides a collapsible canopy which can be folded up in plural directions.

Yet another object of the present invention is to provide a new and improved wagon canopy apparatus which can be moved both vertically and horizontally with a single adjustment.

Even another object of the present invention is to provide a new and improved wagon canopy apparatus that provides a rotatable canopy for a wagon that is not attached to the wagon handle.

Still a further object of the present invention is to provide a new and improved wagon canopy apparatus which does not interfere with the steering and pulling movements of the wagon handle.

Yet another object of the present invention is to provide a new and improved wagon canopy apparatus that enables the wagon canopy to be rotated out of the way for loading and unloading the wagon.

Still another object of the present invention is to provide a new and improved wagon canopy apparatus which is automatically be in a horizontal direction when the canopy is rotated from an out-of-use orientation to an in-use orientation.

Yet another object of the present invention is to provide a new and improved wagon canopy apparatus that has a support structure that readily locks into an in-use orientation when the canopy is transformed from an out-of-use orientation to an in-use orientation.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the wagon canopy apparatus of the invention installed on a wagon with an in-use orientation shown in solid lines and an out-of-use orientation shown in broken lines.

FIG. 2 is ant enlarged perspective view of the portion of the embodiment of the wagon canopy apparatus shown in FIG. 1 that is encircled by circle 2.

FIG. 3 is a top view of the structural support assembly of embodiment of the wagon canopy apparatus of FIG. 1 with the canopy per se removed, wherein an in-use orientation is shown in solid lines and an out-of-use orientation is shown in broken lines.

FIG. 4 is a side view of the structural support assembly of FIG. 3 shown in an in-use orientation.

DESCRIPTION OF THE PREFERRED EMBODIMENT

Figure 5:
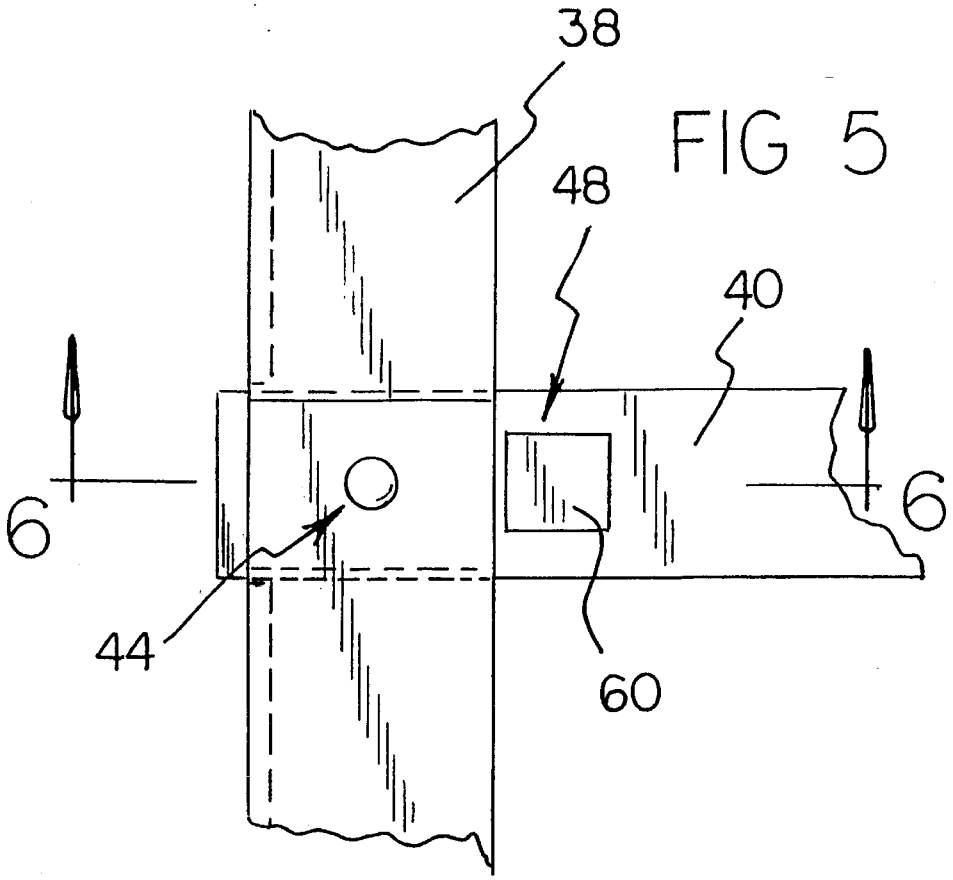
FIG. 5 is an enlarged top view of the encircled portion of FIG. 3.

With reference to the drawings, a new and improved wagon canopy apparatus embodying the principles and concepts of the present invention will be described.

Turning to FIGS. 1–6, there is shown an exemplary embodiment of the wagon canopy apparatus of the invention generally designated by reference numeral 10. In its preferred form, wagon canopy apparatus 10 includes a support bracket assembly 12 adapted to be attached to a wagon 14, preferably at the rear of the wagon 14 so as not to interfere with operation of the wagon handle 15 located at the front of the wagon. A first support assembly 16 is adapted to be connected to the support bracket assembly 12. A second support assembly 24 is adapted to be oriented at a right angle in connection to the first support assembly 16. A primary hinge assembly 26 is connected between the first support assembly 16 and the second support assembly 24. The primary hinge assembly 26 permits movement of the second support assembly 24 from an non-use orientation to an in-use orientation with respect to the first support assembly 16. A canopy element 28 is supported by the second support assembly 24 and covers the wagon 14 when the second support assembly 24 is in the in-use orientation. The canopy element 28 has a top portion 33 and a plurality of side portions 35 which hang down from the top portion 33.

The first support assembly 16 lies in a first plane 17, and the second support assembly 24 lies in a second plane 25. The first plane 17 and the second plane 25 are at right angles to each other. The primary hinge assembly 26 includes a hinge pin 27 that lies adjacent to a line 29 formed by an intersection of the first plane 17 and the second plane 25. The primary hinge assembly 26 connected between the first support assembly 16 and the second support assembly 24 such that the top portion 33 of the canopy element 28 is adapted to lie in the first plane 17 when the canopy element 28 is in a non-use orientation, and top portion 33 of the canopy element 28 lies in the second plane 25 when the canopy element 28 is in an in-use orientation. The primary hinge assembly 26 permits the second support assembly 24 to rotate around the first support assembly 16 through an are of two hundred seventy degrees when the second support assembly 24 is rotated with respect to the first support assembly 16 during shifting the second support assembly 24 from an in-use orientation to a non-use orientation.

The side portions 35 of the canopy element 28 hang down from the top portion 33 of the canopy element 28, and guard screen assemblies 37 are connected to the side portions 35 of the canopy element 28. The guard screen assemblies 37 are made from the same material, such as a fabric material, that the canopy element 28 0is made from. The guard screen assemblies 37 can be rolled up under the inside surface of the side portions 35 of the canopy element 28 when the guard screen assemblies 37 are not in use. To use the guard screen assemblies 37, they are simply unrolled from under the side portions 35 of the canopy element 28. Then, the guard screen assemblies 37 hang down from the side portions 35 of the canopy element 28 providing a screening function for whomever or whatever is located in the wagon 14. The top edges of the guard screen assemblies 37 can simply be sewn onto the side portions 35 of the canopy element 28. When the guard screen assemblies 37 are no longer to be used, they are rolled up again and located under the side portions 35 of the canopy element 28. The guard screen assemblies 37 can be retained in a rolled up condition in a number of ways which include using strings to be tied to keep the guard screen assemblies 37 in a rolled up condition.

The first support assembly 16 includes a first half-right-angle edge 30 adjacent to the primary hinge assembly 26. The second support assembly 24 includes a second half-right-angle edge 32 adjacent to the primary hinge assembly 26. The first half-right-angle edge 30 is adapted to contact the second half-right-angle edge 32 to form a right angle 34 when the second support assembly 24 is an in-use orientation with respect to the first support assembly 16.

The first support assembly 16 includes an outer telescopic member 18 adapted for connection to the support bracket assembly 12. An inner telescopic member 20 is adapted for insertion and adjustment in the outer telescopic member 18, and a first locking assembly 22, supported by the outer telescopic member 18 and the inner telescopic member 20, is adapted for locking the inner telescopic member 20 with respect to the outer telescopic member 18.

To lock the outer telescopic member 18 with respect to the inner telescopic member 20, apertures are provided in both the outer telescopic member 18 and the inner telescopic member 20, and a locking pin 21 is placed through apertures in the outer telescopic member 18 and the inner telescopic member 20 that are placed in registration. Effective vertical height of the first support assembly 16 is adjusted by moving the inner telescopic member 20 into and out of the outer telescopic member 18.

The second support assembly 24 includes a longitudinal strut assembly 36 connected to the primary hinge assembly 26. A first transverse strut assembly 38 is connected to a distal end 40 of the longitudinal strut assembly 36, and a second transverse strut assembly 42 is connected to a proximal end 43 of the longitudinal strut assembly 35. The first transverse strut assembly 38 is connected to the distal end 40 of the longitudinal strut assembly 36 by a pivot assembly 44, and the second transverse strut assembly 42 is connected to the proximal end 43 of the longitudinal strut assembly 36 by a pivot assembly 45.

Figure 6:
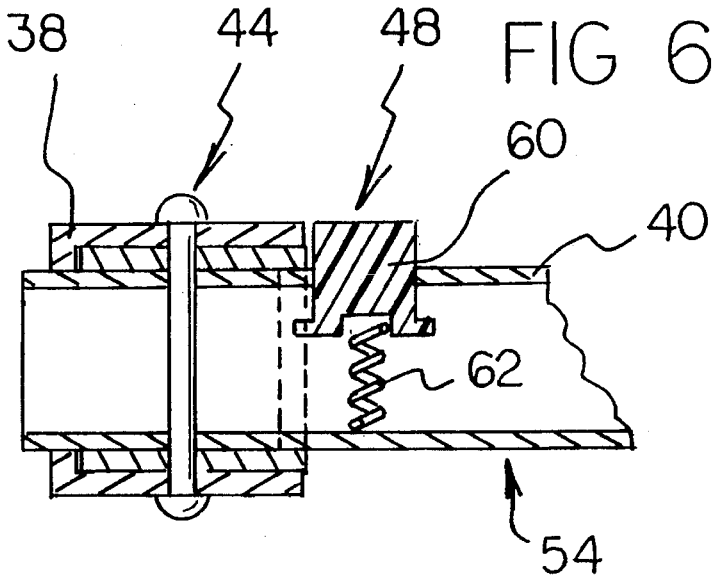
FIG. 6 is a cross-sectional view of the portion of the embodiment of the invention shown in FIG. 5 taken along line 6—6 in FIG. 5.

A second locking assembly 48 is provided for locking the first transverse strut assembly 38 to the longitudinal strut assembly 36 in an in-use orientation, and a third locking assembly 50 is provided for locking the second transverse strut assembly 42 to the longitudinal strut assembly 36 in an in-use orientation. The second locking assembly 48 and the third locking assembly 50 each includes a lock pin 60 supported by a spring 62 in the longitudinal strut assembly 36. There is an aperture in the distal end 40 of the inner longitudinal tube 54 which permits passage therethrough of the lock pin 60 when the second support assembly 24 is in an in-use orientation as shown in solid lines in FIG. 3. Similarly, there is an aperture in the proximal end 43 of the outer longitudinal tube 52 which permits passage therethrough of the lock pin 60 when the second support assembly 24 is in an in-use orientation as shown in solid lines in FIG. 3. When the lock pin 60 is in the locking position as shown in FIG. 6, the lock pin 60 blocks rotation of the first transverse strut assembly 38 around the pivot assembly 44 with respect to the inner longitudinal tube 54. When the second support assembly 24 is to be transformed into a non-use orientation, as shown in transition in broken lines in FIG. 3, the lock pin 60 is manually depressed against the bias of the spring 62 to unload the lock pin 60 from its locking position shown in FIG. 6. When the lock pin 60 is pushed into the inner longitudinal tube 54 to clear its respective aperture, the first transverse strut assembly 38 can readily be rotated around the pivot assembly 44 to reorient the first transverse strut assembly 38 into a non-use orientation. The third locking assembly 50 acts in a similar way for the outer longitudinal tube 52.

The longitudinal strut assembly 36 includes an outer longitudinal tube 52 connected to the primary hinge assembly 26, and an inner longitudinal tube 54 inserted in and in sliding engagement with the outer longitudinal tube 52. A fourth locking assembly 56, supported by the outer longitudinal tube 52 and the inner longitudinal robe 54, is provided for locking the outer longitudinal tube. 52 and the inner longitudinal tube 54 together in a selected position. The first transverse strut assembly 38 is pivotally connected to the inner longitudinal tube 54, and the second transverse strut assembly 42 is pivotally connected to the outer longitudinal tube 52. To lock the inner longitudinal tube 54 with respect to the outer longitudinal tube 52, apertures are provided in both the inner longitudinal tube 54 and the outer longitudinal tube 52, and a locking pin 53 is placed through apertures in the inner longitudinal tube 54 and the outer longitudinal tube 52 that are placed in registration. Effective horizontal length of the longitudinal strut assembly 36 is adjusted by moving the inner longitudinal tube 54 into and out of the outer longitudinal tube 52.

The wagon canopy apparatus 10 can be collapsed into a compact form for storage when the canopy element 28 is removed from the second support assembly 24, the second locking assembly 48 is unlocked and the first transverse strut assembly 38 is rotated around the pivot assembly 44 to be in alignment with the longitudinal strut assembly 36, the third locking assembly 50 is unlocked and the second transverse strut assembly 42 is rotated around the pivot assembly 46 to be in alignment with the longitudinal strut assembly 36, the fourth locking assembly 56 is unlocked and the inner longitudinal tube 54 is slid into the outer longitudinal tube 52, and the first locking assembly 22 is unlocked and the inner telescopic member 20 is slid into the outer telescopic member 18. The second support assembly 24 may also be rotated around the primary hinge assembly 26 to further provide a compact package for storage.

The components of the wagon canopy apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved wagon canopy apparatus that is low in cost, relatively simple in design and operation, and which may advantageously be used with a wagon, such as a four-wheeled wagon commonly used by children. With the invention, a wagon canopy apparatus provides a collapsible canopy which can be folded up in plural directions. With the invention, a wagon canopy apparatus is provided which can be moved both vertically and horizontally with a single adjustment. With the invention, a wagon canopy apparatus provides a rotatable canopy for a wagon that is not attached to the wagon handle. With the invention, a wagon canopy apparatus is provided which does not interfere with the steering and pulling movements of the wagon handle. With the invention, a wagon canopy apparatus is provided which enables the wagon canopy to be rotated out of the way for loading and unloading the wagon. With the invention, wagon canopy apparatus is provided which is automatically be in a horizontal direction when the canopy is rotated from art out-of-use orientation to an in-use orientation. With the invention, a wagon canopy apparatus is provided which has a support structure that readily locks into an in-use orientation when the canopy is transformed from an out-of-use orientation to an in-use orientation.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

What is claimed as being new and desired to be protected by Letters Patent of the United States is as follows:

1. A wagon canopy apparatus, comprising:

a support bracket assembly adapted to be attached to a wagon, a first support assembly removably connected to said support bracket assembly, a second support assembly movably connected to said first support assembly, a primary hinge assembly connected between said first support assembly and said second support assembly, said primary hinge assembly permitting movement of said second support assembly from an out-of-use orientation to an in-use orientation with respect to said first support assembly, and a canopy element, supported by said second support assembly, for covering the wagon when said second support assembly is in the in-use orientation, wherein said second support assembly includes:

a longitudinal strut assembly connected to said primary hinge assembly, a first transverse strut assembly connected to a distal end of said longitudinal strut assembly, and a second transverse strut assembly connected to a proximal end of said longitudinal strut assembly.

2. The apparatus of claim 1 wherein:

said first support assembly lies in a first plane, said second support assembly lies in a second plane, said first plane and said second plane are at right angles to each other, and said primary hinge assembly includes a hinge pin that lies adjacent to a line formed by an intersection of said first plane and said second plane.

3. The apparatus of claim 2 wherein said primary hinge assembly is connected between said first support assembly and said second support assembly such that said canopy element is adapted to lie in said first plane when said canopy element is in a non-use orientation, and canopy element lies in said second plane when said canopy element is in an in-use orientation.

4. The apparatus of claim 1 wherein:

said first support assembly includes a first half-right-angle edge adjacent to said primary hinge assembly, said second support assembly includes a second half-right-angle edge adjacent to said primary hinge assembly, said first half-right-angle edge is adapted to contact said second half-right-angle edge to form a right angle when said second support assembly is an in-use orientation with respect to said first support assembly.

5. The apparatus of claim 1 wherein said primary hinge assembly permits said second support assembly to rotate around said first support assembly through an arc of two hundred seventy degrees when said second support assembly rotated with respect to said first support assembly during shifting said second support assembly from an in-use orientation to a non-use orientation.

6. The apparatus of claim 1 wherein said first support assembly includes:

an outer telescopic member adapted for connection to said support bracket assembly, an inner telescopic member adapted for insertion and adjustment in said outer telescopic member, and a first locking assembly, supported by said outer telescopic member and said inner telescopic member, adapted for locking said inner telescopic member with respect to said outer telescopic member.

7. The apparatus of claim 1 wherein;

said first transverse strut assembly is connected to said distal end of said longitudinal strut assembly connected by a pivot assembly, and said second transverse strut assembly connected to said proximal end of said longitudinal strut assembly by a pivot assembly.

8. The apparatus of claim 1 further including:

said second locking assembly for locking said first transverse strut assembly to said longitudinal strut assembly in an in-use orientation, and a third locking assembly for locking said second transverse strut assembly to said longitudinal strut assembly in an in-use orientation.

9. The apparatus of claim 1, wherein said longitudinal strut assembly includes:

an outer longitudinal tube connected to said primary hinge assembly, and an inner longitudinal tube inserted in and in sliding engagement with said outer longitudinal tube, and a fourth locking assembly, supported by said outer longitudinal tube and said inner longitudinal tube, for locking said outer longitudinal tube and said inner longitudinal tube together in a selected position, wherein said first transverse strut assembly is pivotally connected to said inner longitudinal tube and said second transverse strut assembly is pivotally connected to said outer longitudinal tube.

10. The apparatus of claim 1 wherein said canopy element includes a top portion and a plurality of side portions which hang down from said top portion.

11. The apparatus of claim 10, further including:

guard screen assemblies connected to said side portions of said canopy element.

12. The apparatus of claim 11 wherein said guard screen assemblies are made from fabric material and are adapted to be rolled up under said side portions of said canopy element.

* * * * *